US005292207A

United States Patent [19]

Scott

[11] Patent Number: 5,292,207

[45] Date of Patent: Mar. 8, 1994

[54] ICE CRUSH RESISTANT CAISSON FOR ARCTIC OFFSHORE OIL WELL DRILLING

[75] Inventor: William A. Scott, Calgary, Canada

[73] Assignee: Allen Bradford Resources, Inc., Calgary, Canada

[21] Appl. No.: 18,446

[22] Filed: Feb. 17, 1993

[51] Int. Cl.[5] ..... E02B 17/00

[52] U.S. Cl. ..... 405/207; 405/210; 405/211; 405/217

[58] Field of Search ..... 405/195.1, 203, 205, 405/207, 211, 217, 210

[56] References Cited

U.S. PATENT DOCUMENTS

| | | | |
|---|---|---|---|
| 4,431,346 | 2/1984 | Husebye . | |
| 4,512,684 | 4/1985 | Hale et al. | 405/217 |
| 4,596,291 | 6/1986 | Makinen et al. . | |
| 4,699,545 | 10/1987 | Chen et al. . | |
| 4,786,210 | 11/1988 | Williams | 405/217 |
| 4,963,058 | 10/1990 | Broughton et al. | 405/207 |
| 5,098,219 | 3/1992 | Harrington . | |

FOREIGN PATENT DOCUMENTS

| | | |
|---|---|---|
| 1127359 | 7/1982 | Canada . |
| 1178812 | 12/1984 | Canada . |
| 1232768 | 2/1988 | Canada . |
| 2145849 | 6/1973 | France . |
| 1276748 | 12/1986 | U.S.S.R. . |
| 1308713 | 5/1987 | U.S.S.R. . |
| 1700138 | 12/1991 | U.S.S.R. . |
| 2185446 | 7/1987 | United Kingdom . |

*Primary Examiner*—David H. Corbin

*Attorney, Agent, or Firm*—Bell, Seltzer, Park & Gibson

[57] ABSTRACT

A submersible mobile caisson having ice crush resistance for adapting semi-submersible mobile offshore drilling units and mobile offshore oil well production rigs, which are ice crush sensitive for use in ice bearing offshore ocean waters, is provided. The caisson comprises a floatable generally four sided structure composed of front and rear outer walls, and opposing side outer walls, with the rear outer wall having a removable entrance door. Inner walls are positioned in a spaced apart, opposing relationship with each of the outer walls, and so that the inner and outer walls define a perimeter structure and the inner walls define a cavity which is located within the perimeter structure. The perimeter structure has a plurality of ballast compartments which permit the caisson to float or be sunk so as to rest on the ocean floor. A drilling/production moon pool system is also provided in the perimeter structure.

15 Claims, 11 Drawing Sheets 212
116
220
214
24
222
240
226
236
244
234
218
238
216
230
224
10
232
242
246
118
16
228
90
42
44
254
248
252
218
250
46
102
216
60

ICE CRUSH RESISTANT CAISSON FOR ARCTIC OFFSHORE OIL WELL DRILLING

FIELD OF THE INVENTION

This invention relates to submersible mobile caissons particularly useful in offshore oil well drilling and oil well production in ice-bearing offshore ocean waters, such as the Arctic.

BACKGROUND OF THE INVENTION

Arctic offshore regions are viewed as the last frontier of oil and gas mega project development. There are vast untapped oil-bearing regions lying from the Canadian and American Beaufort Seas around the Arctic Circle through to the oil-prone regions of Russia. The areas have seen a lot of activity, but little or no offshore production has been realized. The lack of development has been caused primarily by the capital expenditure required to achieve production versus the currently depressed oil prices. Hence any development in the Arctic has continued to be uneconomic. However given the vast deposits in the Arctic, it is worthwhile developing. In view of the manner in which conventional offshore drilling and production systems have adapted to the lower oil prices, it is timely to develop an economic approach to the exploration, drilling and production of offshore oil wells in the Arctic.

Three approaches used in the non-Arctic areas of offshore drilling and production are of interest with respect to rendering such projects economic. These approaches are in the form of subsea templates, tender assisted drilling (TAD) and jack-up drilled wellhead platforms. Subsea template concepts work reasonably well in offshore areas; however, would not be acceptable in the Arctic due to potential problems with ice scour on the sea floor and the consequences of ice impact on the template. Furthermore, this approach is not in step with the very limited drilling season in the Arctic which may be in the range of 100 to 120 days. In this period at best, one might drill and complete two shallow wells where, in actual fact, some twenty to forty wells might be required to develop a field.

Tender assisted drilling overcomes the problems associated with drilling equipment taking up space on production platforms. However, these systems are not suitable for use in the Arctic since they are very ice crush sensitive.

Jack-up drilled wellhead platforms, which are a version of a tender assisted drilling, are suitable for shallow water depths and benign environmental regions. Although the systems are economic, they are ice crush sensitive and would not be suitable for unprotected use in the Arctic.

Attempts to achieve year-around oil well drilling and production have to some extent been satisfied by five basic systems which are either no longer in use or have limited use:

1. ice islands;
2. sacrificial beach islands;
3. ice strengthened drill ships with ice class support;
4. shallow caisson retained islands; and
5. deep mobile Arctic caissons.

Ice islands have very limited application, certainly in waters no deeper than fifteen meters. A common problem with ice islands is their tendency to break-up and hence problems in maintaining the stability of the ice platform through summer months. Sacrificial beach islands are possible in water depths of fifteen to twenty meters. Such islands are very expensive to construct and do not lend themselves to any form of mobility as the need might arise to move the drilling and/or production equipment. Furthermore, the shallow slope of the island construction leads to problems with wave run-up and a continual need to maintain the shore of the island. Ice strengthened drill ships are possible; however, such ships are dedicated to either full scale Arctic drilling or production development. Such units are almost solely dedicated to exploration or production drilling and have no practical application as a production unit. Shallow caisson retained islands are another possible solution, like a sacrificial beach island are subject to potential wave erosion. They also do not lend themselves well to efficient topside design and, as such, have limited application.

Deep mobile Arctic caissons have become accepted to some extent in drilling and/or production in the Arctic. Such units have the ability to operate in deeper water depths even up to forty to fifty meters, but preferably in the range of twenty meters. Such units are very large and usually combine drilling with a limited production testing capability. However, the space taken up by the drilling systems is constant and can represent some 50% of the available deck area so that, once drilling is completed, this space is wasted for production purposes.

Examples of these types of units are found in the prior art. Ice structures are disclosed in U.S. Pat. No. 4,699,545. The ice island is developed by spraying water. However considering the size of the ice island to be developed, this can be a time-consuming program with a limited winteruse only application. Another technique for developing large bodies of ice, which may be used in offshore drilling, is disclosed in U.S. Pat. No. 4,431,346. U.S. Pat. No. 4,596,291 discloses a floating, semi-submersible offshore drilling platform which is dedicated to the drilling of oil wells. The drilling unit is to some extent movable on the platform for drilling from various positions. The system is protected against ice by mounting the platform on a submersible pontoon which may be formed of concrete. When winter sets in, the system is elevated where the concrete portion of the system resists impact of ice. In order to protect the drilling system during the winter months, the drilling may take place through one of the columns which is connected to the pontoon portion, hence protecting the drill system from ice in the winter months. It is apparent, however, that this system would have limited use in heavy ice areas, such as in the Arctic. Another form of mobile semi-submersible caisson for use in oil well drilling is disclosed in U.S. Pat. No. 5,098,219. This system involves the sinking of a caisson beneath the water where the drilling system is contained within the caisson. The crew is always within the caisson where they move to and from their quarters by way of an elevator. This is, of course, not conducive to long term drilling operations, because of the submerged nature of the system.

A semi-submersible oil production system is disclosed in U.K. patent application 2,185,446. The system is in the form of an octagon which provides a strong-box structure enclosing a number of production decks. However, this system is tied down by cables and hence is not particularly suitable for use in the Arctic. Little or no consideration to ice resistance has been given in the design of the underwater pontoon hull.

Floatable caissons, which are capable of being sunk to rest on the ocean floor and which are suitable for use in the Arctic, are disclosed in Russian patent 1,700,138 and Canadian patent 1,178,812. The Russian design is circular in shape, reinforced about its perimeter and filled with fill material to stabilize the ballasted structure. Similarly, the caisson of the Canadian patent is ballasted to rest on the ocean floor and then the central region thereof filled with fill material which is kept in an unfrozen state. The perimeter of the caisson defines a support on which an upper working deck is constructed. Drilling or production can take place from the working deck. The perimeter of the caisson is designed to have a sloping surface which causes advancing ice to wedge upwardly, break and fall away from the caisson. The caisson, when in position, does permit year round drilling and at any time when the Arctic is reasonably free of ice cover, can be floated and moved to another location. However during its use, the systme is either normally dedicated to drilling production or both drilling and production with the consequent increase in capital expenditure.

To some extent the demands in oil well drilling and production have been met by the prior art, particularly the submersible caisson of Canadian patent 1,178,812. However, the capital expenditure associated with this type of caisson design requiring its own form of oil well drilling and/or oil well production unit, is far too high hence rendering its use uneconomic in the Arctic for purposes of oil well production.

According to this invention, a submersible mobile caisson is provided which addresses these problems and allows the use of readily available, inexpensive, mobile offshore drilling units and mobile offshore production units which, in their normal habitat, are ice crush sensitive and could not, without the caisson of this invention, be used in the Arctic. The mobile caisson of this invention accomplishes these features without the normally prohibitive capital expenditure. The mobile caisson of this invention provides for:

1. achievement of rapid, first oil production date;
2. ease of construction and installation and hook-up;
3. use of converted mobile offshore drilling units;
4. separation of drilling and production functions as required;
5. potential use of tie-back wells;
6. provides for twin drilling facilities not possible on other mobile caissons with the additional advantage of relief well drilling capability;
7. minimizes impact of the drilling facilities on the platform design;
8. is capable of a multi-well drilling through separated well bases, i.e. multi-slot drilling;
9. a self-sufficient system;
10. provides for export of recovered oil; and
11. can be mobilized and moved to any desired region in the Arctic.

SUMMARY OF THE INVENTION

In accordance with an aspect of this invention, a submersible mobile caisson having ice resistance for adapting mobile offshore drilling units and mobile offshore oil well production rigs which are ice crush sensitive, for use in ice bearing offshore ocean waters, the caisson comprises:

i) a floatable generally four-sided caisson with a fixed upstanding front outer wall and fixed upstanding opposing side outer walls and an upstanding rear outer wall having a removable entrance door, ii) the caisson being of a height to permit offshore drilling and/or production when the caisson is submersed to rest on an ocean floor, iii) the outer walls being reinforced to withstand crushing forces exerted by ice bearing offshore oceans and the outer wall height being sufficient to turn back a maximum design wave, the outer walls having an inwardly sloping wall portion about caisson perimeter above and below submersed water level to wedge upwardly advancing ice, iv) the upstanding front and rear walls and the opposing side walls define a cavity, access to which is provided by removing the entrance door, v) the cavity has a base, a front inner wall, opposing side inner walls and a rear inner wall on the entrance door, the inner walls being spaced from corresponding outer walls of the front and opposing sides with an upper support deck spanning the spaced apart outer and inner walls, the front wall and rear wall including the door and the side inner and outer walls define a caisson perimeter structure, the interior space of the cavity being protected from ice crushing forces by the caisson perimeter structure, vi) the perimeter structure and the base have a plurality of ballast compartments to float the caisson and when the compartments are filled with a ballast liquid, the caisson sinks towards and rests on the ocean floor where the caisson perimeter structure is of a height to provide above water level a sea break to safeguard operating facilities and personnel, vii) the base of the cavity is positioned relative to the deck to provide sufficient draft when the caisson is floating and the door is open to permit entrance and exit of mobile offshore drilling units and/or production units, viii) the deck along each of the opposing sides has at least one drilling/production service hatch, ix) each of the side portions of the perimeter structure has extending vertically therethrough, a drilling/-production moon pool system which extends from and is in communication with the corresponding service hatch, x) the caisson perimeter structure comprises an ocean floor perimeter foot portion of solid reinforced structural material, the cavity base being of reinforced structural material tied into the perimeter foot portion, xi) the inner and outer walls to at least above submersed water level when the perimeter foot is resting on ocean floor are of reinforced structural material, the plurality of the ballast compartments being provided between the inner and outer walls with a majority of each ballast compartment being below submersed water level when the perimeter foot is resting on ocean floor.

Other aspects of the invention along with their attended features and advantages over the prior art systems will become apparent in the following detailed description of the preferred embodiments.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
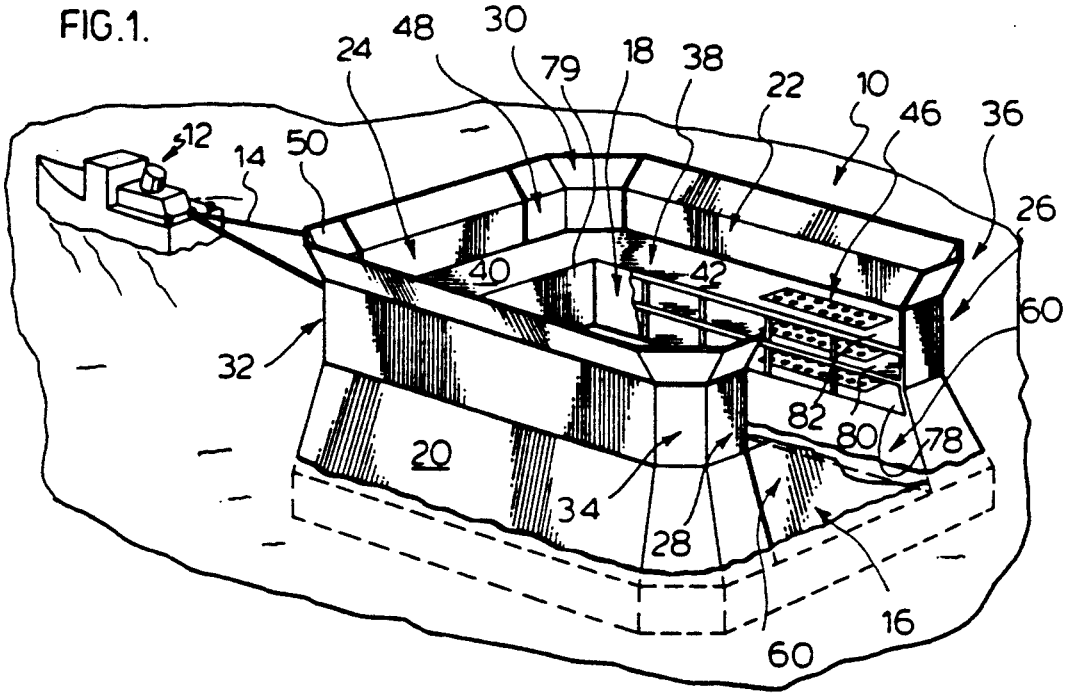
FIG. 1 is a perspective view of the submersible mobile caisson in accordance with an aspect of the invention.

The submersible mobile caisson 10 of FIG. 1 is in its floating position as towed by a tug boat 12 connected to the caisson by tow cables 14. The caisson, in its floating position, may have its rear door removed to provide an entrance 16 to the cavity region 18 of the caisson 10. However, when the caisson is being towed, the door is in position to close off the cavity 16 in the manner shown in FIG. 1 where the door 60 (in partial) closes off the caisson rear. The caisson 10 has opposing side walls 20 and 22 which are spaced apart and joined by front wall 24. The rear wall has rear wall portions 26 and 28 with the rear door positioned between the wall portions to complete the perimeter of the caisson structure. The opposing side walls, front and rear wall are interconnected by angled portions to define a generally four-sided caisson having respective angled corner portions 30, 32, 34 an 36. The perimeter of the caisson supports and upper U-shaped working deck 38 which has a front portion 40 and opposing side portions 42 and 44 (shown in FIG. 12). In each side working platform is a template 46 and 48 which locate the drilling and tie-back of the production wells by the respective drilling unit.

Figure 12:
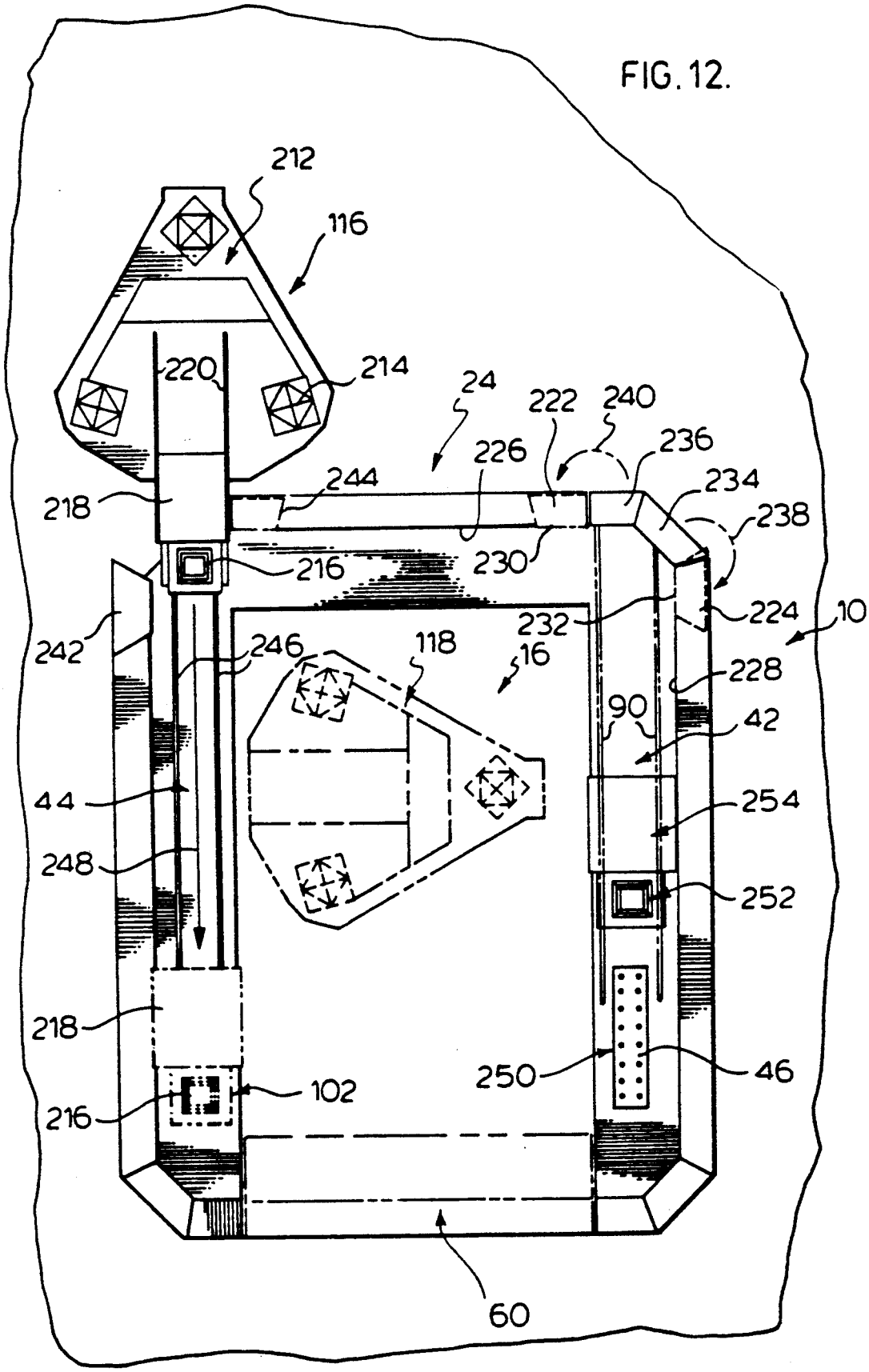
FIG. 12 is a top plan view of the caisson with a mobile offshore drilling unit within its perimeter protected from the environment and a mobile offshore drilling unit unloading a drill unit onto the working platform of the caisson.

The forward corner portions 30 and 32 each have an upper section 48 and 50 which may be hinged outwardly to provide access to the forward portions of the side decks 42 and 44 and the front deck 40 for purposes of and loading jack-up oil drilling rigs in a manner to be discussed with respect to FIG. 12.

Figure 3:
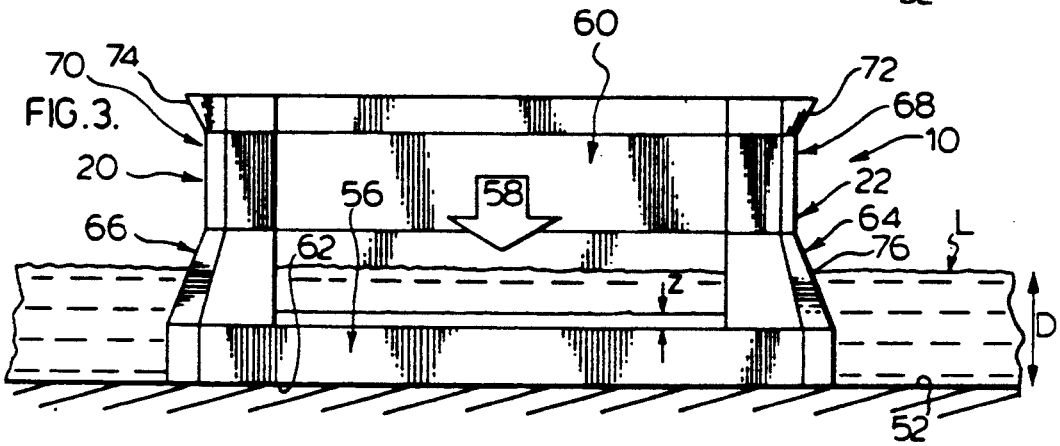
FIG. 3 is a side elevation the same as FIG. 2 with the mobile caisson ballasted to rest on the ocean floor.

The caisson is of a height to permit offshore drilling and/or production such that when the caisson is submersed to the extent shown in FIG. 3, water depths of up to approximately 50 m can be accommodated. A berm or the like foundation may be established to support the caisson when submersed in the deeper waters.

Figure 2:
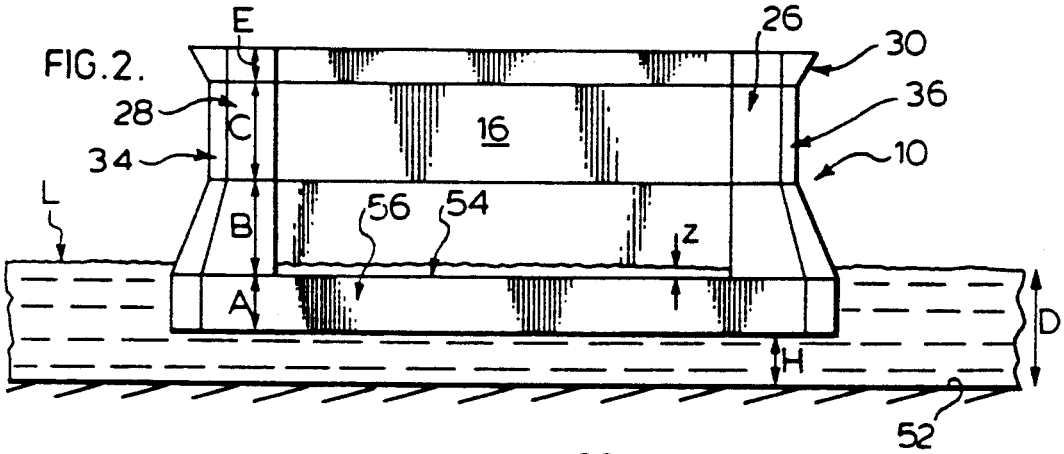
FIG. 2 is a view of the mobile caisson of FIG. 1 through the rear doorway.

FIG. 2 illustrates the caisson 10 when in the floating position in a water depth of perhaps 10 to 50 m, as indicated by an ocean depth D. The caisson 10 is above the ocean floor 52 by a height H when in its floating unballasted position. The water level L may be above the surface 54 of the caisson base 56. The height of the water in the cavity 16 as indicated at Z may be in the range of 3 to 5 m. It is appreciated that depending upon the floated position of the caisson, the water level height Z within the cavity 16 will vary. The need for change in this height will become apparent in the discussion of moving mobile offshore drilling units and other semi-submersibles into and out of the caisson cavity 16.

The caisson 10 when in position over the ocean floor 52 is ballasted to sink in the direction of arrow 58 as shown in FIG. 3. The caisson can be sunk with the door in place or otherwise. Once installed, the door is not intended to provide a watertight seal but is purely intended as an ice-crush resistant removable door to permit the entry and exit of ice-crush sensitive mobile offshore drilling units and structures. The water level within the cavity 16 will be at the same level as indicated by the water level L. In order to sink the caisson 10 the ballast compartments of the caisson are ballasted with a ballast liquid, at least until the caisson 10 begins to sink. The caisson is steadied in position by the usual use of tug boats and cables to guide its orientation while sinking. By use of appropriate pumps the rate of sinking may be controlled to ensure the desired location of the caisson on the ocean floor 52. As the caisson sinks, the height H between the base 51 of the caisson and the ocean floor diminishes until the underside 62 of the caisson base 56 contacts the ocean floor. The caisson is designed such that the depth of the ocean D defines a water level L in the region of the inwardly sloping surface 64 of side wall 22 or as shown on the opposing side inwardly sloping surface 66 of the side wall 20. The purpose of this inwardly sloping surface such as 64 and 66 shall be described in more detail with respect to FIG. 18 in regards to resisting and breaking up fresh or old ice and also assists in turning back the wave action. Above the inwardly sloping surfaces are vertical surfaces, for example, surfaces 68 and 70 of the opposing side wall 20 and 22. Above those surfaces are the outwardly sloping skirt sections 72 and 74. As noted with respect to FIG. 1, the outwardly sloping skirt portions 30, which includes sections 72 and 74, extends around the entire perimeter to turn back maximum wave design which may be in the range of 20 to 30 m to avoid washing over the caisson perimeter. Usually, the caisson has an overall height of 45 m although engineering for site specific applications may cause this dimension to vary. It is desired that the water line L intersect the inwardly sloping surfaces such as at 76 for surface 64 to provide approximately 5 m above and below the tide water mark 76. Other dimensional aspects of the caisson include a base height A of approximately 10 m, an inwardly sloping wall height B of 17.5 m, a vertical wall height C of 13.5 m and a deck deflector height E of approximately 4 m. Within the caisson, the height of the working decks 42, as constituted by working surfaces 78, 80 and 82, may be in the range of 5 to 5.5 m between decks 78 and 80 and between decks 80 and 82 to provide total deck height in the range of 11 to 12 m from deck 78 to deck 82. The upper deck 82, with the dimensions provided with respect to FIG. 2 is approximately 34 m above the base underside 62. It is appreciated of course that these dimensions are simply exemplary and that depending upon the region in which the caisson is designed to operate, the height may be proportionally increased or decreased to compensate for the depth D of the ocean. It is also understood that the working decks 78 and 80 are usually enclosed by suitable cladding such as shown in partial at 79. Such cladding may be permanent with perhaps portions thereof removable to permit lateral access to the decks 78 and 80.

With the caisson properly ballasted, the caisson is of sufficient weight to rest on the ocean floor in a manner to permit year round drilling and/or oil well production without the caisson shifting on the ocean floor. As required, the caisson can be deballasted to permit floating of the caisson or movement to another work area. Furthermore, as will be discussed, the rear door 60 can be removed with the caisson in the sunk position, as shown in FIG. 3. With the door removed, it is relatively straight forward to float in and out of the cavity various mobile offshore drilling units and/or oil production units so that they are protected from the environment within the cavity 16. This is particularly important in the winter time when the ice crush sensitive drilling or production rigs need to be protected from the destructive forces of ice flows and formation of fresh ice.

In comparing the caisson of this invention to the prior art caissons and the provision of a cavity within the caisson to which access is provided through a removable door, several significant and unexpected advantages are provided. The caisson enables the use of readily available ice crush sensitive mobile offshore drilling units and full production units. Such units have safe passage into and out of the caisson where full protection from the elements is provided inside the caisson. A considerable cost saving is realized to reduce the initial capital expenditure of the system. Considerable space is provided in the caisson base and side walls to provide for ballast and oil storage. Ballast is used in setting the position of the caisson. The oil storage is such to support year round offshore loading even from a large oil producing field. The caisson has separated well bays for drilling where the drilling towers are located a safe distance from the front of the caisson where accommodation would normally be provided. The caisson may be used as a heavy lift vessel due to its ability to take all manner of units inside its cavity 16 and by insertion of the ice resistant door and ballasting upwards, be capable of taking these units long distances through either normal or ice-infested waters. This heavy lifting use may be independent of any caisson use associated with oil field production.

Figure 4:
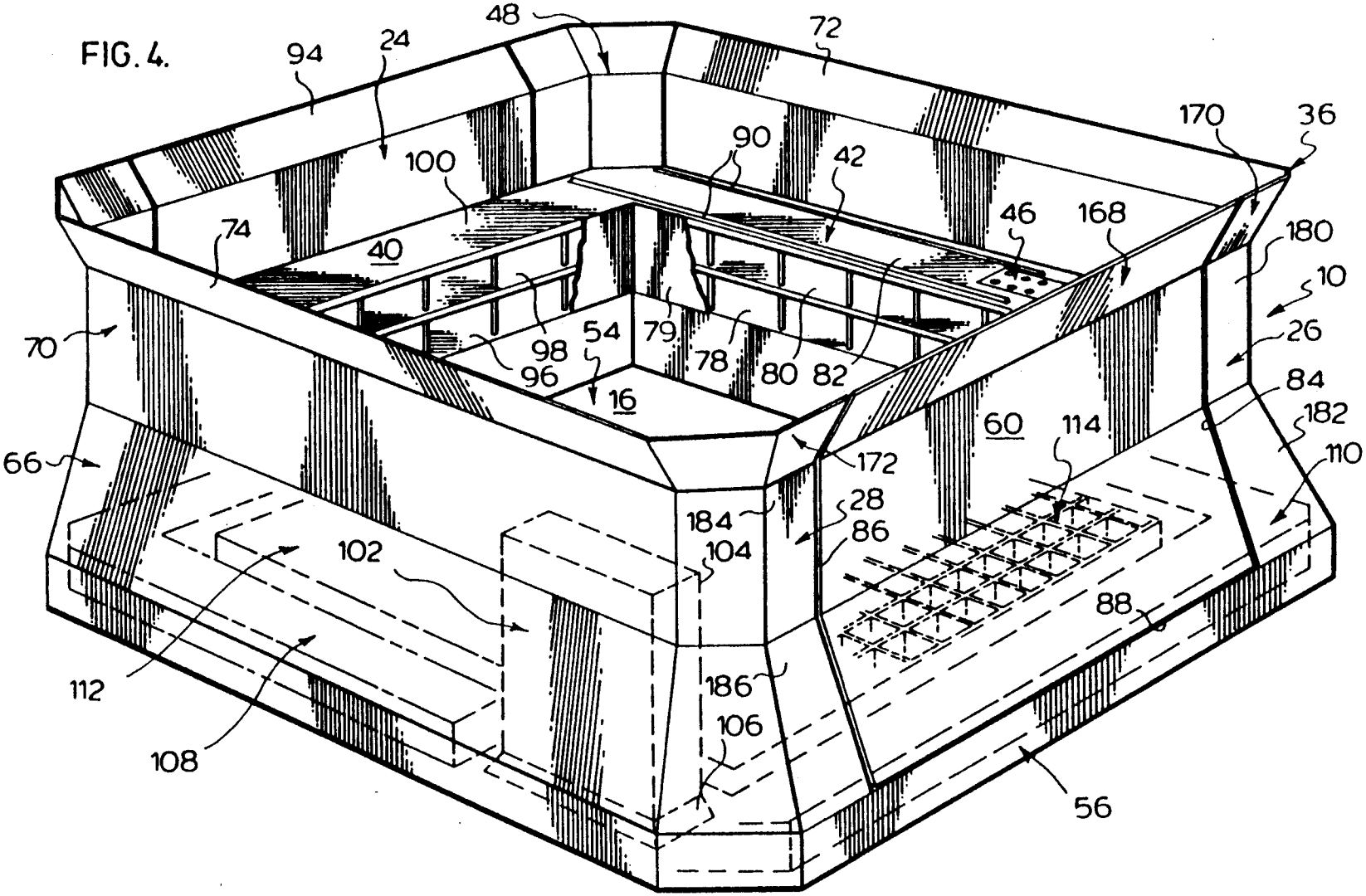
FIG. 4 is a perspective view of the mobile caisson of this invention showing further details of the working deck perimeter construction and ballast and storage compartments.

These advantages and features are accomplished by the caisson as shown in an enlarged view in FIG. 4 where the removable door 60 is shown in place to complete the cavity area 16 and enclose it and protect it from the elements. The details in the mounting, closure and sealing of the door to the caisson rear end portions 26 and 28 are further discussed in FIGS. 10 and 11. The perimeter of the door as it fits with the caisson is defined by door sides 84 and 86 and its base 88. The door engages edges 84 and 86 of the rear wall portions 26 and 28. The base 88 also engages the caisson base 56. Whilst the door is not watertight, it has a tight enough fit to prevent wave and tidal action being a detrimental effect to operations within the cavity 16. During the winter months, it is appreciated that sufficient heat is generated by drilling and production to minimize or avoid freeze-up of water in the cavity to ensure that units protected within the cavity are not damaged.

The upper deck 82 which has the templates 46 provided therein, has spaced apart skid rails 90 provided and secured on its surface. With the front skirt portion 48 opened up a jack-up drill may be skidded onto skid rails 90 and then moved along the skid rails over the templates 46 to commence the drilling or tie-back operations. Such skidding of the drill tower from the jack-up rigs is shown in FIG. 12, which will be discussed in more detail. The corner skirts 48 may be removed in a variety ways. The preferred approach in removing the skirts 48 is by way of a hinged structure to be described with reference to FIG. 12.

The accommodation for the personnel in operating the drilling and oil production rigs, maintenance of the caisson may be housed in accommodations which would be placed on the front upper deck 40. Such accommodation may be in the form of multiple apartment units which may range up to 50 apartments or more. Such apartment complex may extend above the wave deflector plate 94 provided on the front wall 24 of the caisson. By locating the drill towers and accommodation on the upper deck of the opposing side and front decks. A working, material storage and equipment lay down area may be provided on the lower deck 78 and 80 of side 42 and on decks 96, 98 and 100 of the front portion of the caisson perimeter. Similarly, for the opposing side 42, corresponding below working decks are provided.

Beneath the template 46, such as shown on the other side of the caisson, is a moonpool 102. The moonpool comprises a silo 104 with an outwardly tapered base 106. The silo 104 extends through the decking structure and through the reinforced base portion of the caisson by providing two moonpools on the spaced apart decks. Simultaneous drilling of two wells can take place from respective drilling towers. The moonpools are located at the rearmost portion of the caisson so as to be spaced a considerable distance from the accommodation on front deck 40. In view of the caisson sizing, this spacing may be in the range of 100 to 150 m which ensures that the personnel and the accommodation are in safety should one of the wells being drilled blow out and result in a fire.

The sides of the caisson are made of reinforced materials, whether it be steel or concrete, where such configuration and reinforcing will be discussed in more detail with respect to FIG. 18. Such reinforcing in the caisson perimeter and base is such to permit the location of several ballast tanks in the caisson perimeter including the portion of the base beneath the rear door 60. A ballast tank system 108 is provided which extends from moonpool 102 around to the moonpool beneath template 46 of deck 42. The system of ballast tanks 108 is partitioned to achieve a separation between the tanks for storage of different materials and as well to prevent leaking to the atmosphere of the entire ballast region should one or more of the ballast tanks in the system 108 be punctured. As will be discussed with respect to FIG. 18, the outer portion of the base perimeter is significantly reinforced to withstand any normal form of impact by ice or the like. However, should a ship inadvertently bunt up against the caisson and possibly puncture the outer reinforcement, only one or two of the ballast tanks would be ruptured to release their contents which would not have any significant upsetting impact on the caisson in view of there being several of such individual ballast tanks. Similarly, around the back of the caisson perimeter is a ballast tank system 110 which extends in the rear of moonpool 102 around to the rear of the moonpool beneath template 46. It is also correspondingly configured with a plurality of individual tanks, such as with the system 108 where the ballast may extend beneath the door 60 through the perimeter of the caisson base 56. Within this perimeter ballast tank system 108 and 110 is another ballast tank system 112 which is located within the floor of the cavity base 56. The interior ballast tank system 112 beneath the cavity 16 comprises a grid work of compartmentalized ballast tanks 114, as shown in dot. These individual ballast tanks may be fed individually from a central pump system into which water or oil is pumped for ballast or storage purposes. It is appreciated that at all times an acceptable balance between the amount of oil in the caisson and the amount of water stored in the caisson, including the weight of equipment in the caisson, is such to ensure that the caisson is either in the floated or the sunk positions of FIGS. 2 and 3. Normally the capacity of the tanks in the caisson may be sufficient to store in the range of 600,000 barrels of oil. Up to an additional 600,000 barrels of oil may be stored through the use of suitable tankage in the mobile offshore drilling units or production structures which will be placed within the cavity 16. This gives an oil storage potential of approximately 1,200,000 barrels with the remainder of the storage being water and still providing sufficient ballast to keep the caisson in the sunk position of FIG. 3. With storage potential of 1,200,000 barrels this would permit use of this caisson, according to this invention, on the largest of oil structures currently conceived in the Arctic. Such storage capability would also rival some of the most current North sea structures.

Figure 5:
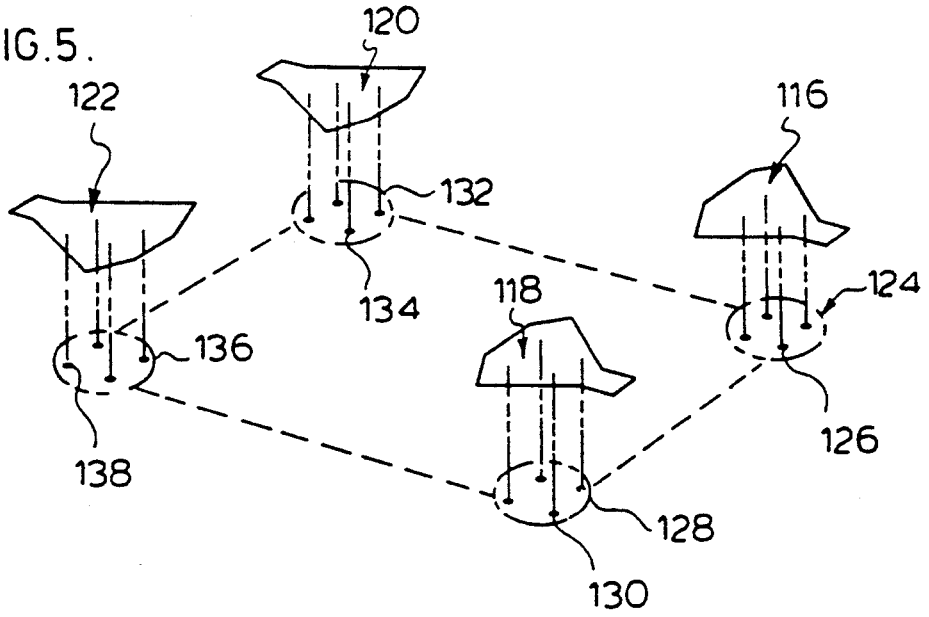
FIG. 5 is a schematic demonstrating the drilling of four tie-back wells using mobile offshore drilling units.

As noted with respect to FIGS. 1 and 4, the moonpool area 102 is designed to accommodate a combination of tie-back wells and platform drilled wells. An area dedicated to the typing back of pre-drilled wells is located at either end of the intermediate drilled wells. Directly below each of these areas a concrete silo is built in the seafloor. This concrete silo can accommodate the drilling of a 4 well template from a jack-up mobile offshore drilling unit. With two such silos within each wellbay area the potential exists to pre-drill up to 16 wells before the arrival of the caisson. Normally the spacing between each of these tie-back areas would be determined by the number of platform drilled wells required by would not be expected to be less than 25 to 30 m. The tie-back wells can be drilled and cemented in place during a summer phase while the caisson is in the final stages of manufacture. At the beginning of ice opening mobile offshore drilling units may be employed to drill and cement in the tie-back wells in the manner demonstrated in FIG. 5. Four separate mobile drilling units, generally designated 116, 118, 120 and 122 may be provided where each mobile unit is capable of drilling and completing two of the four tie-back wells in a typical summer open water season of 100–120 days. With the capability to deploy up to four jack-ups simultaneously, as shown in FIG. 5, it is possible to predrill all 16 wells within two summer seasons. This represents a considerable advance over current arctic concepts. As shown in FIG. 5, tie-back caisson 124 have drilled therein individual wells 126. Similarly, tie-back casing 128 has four individual wells 130. Tie-back casing 132 has four individual wells 134 and tie-back casing 136 has four individual wells 138. It is understood that each mobile offshore drilling unit is capable of positioning its drilling derrick over any of the proposed wells without repositioning the drilling unit itself.

Figure 6:
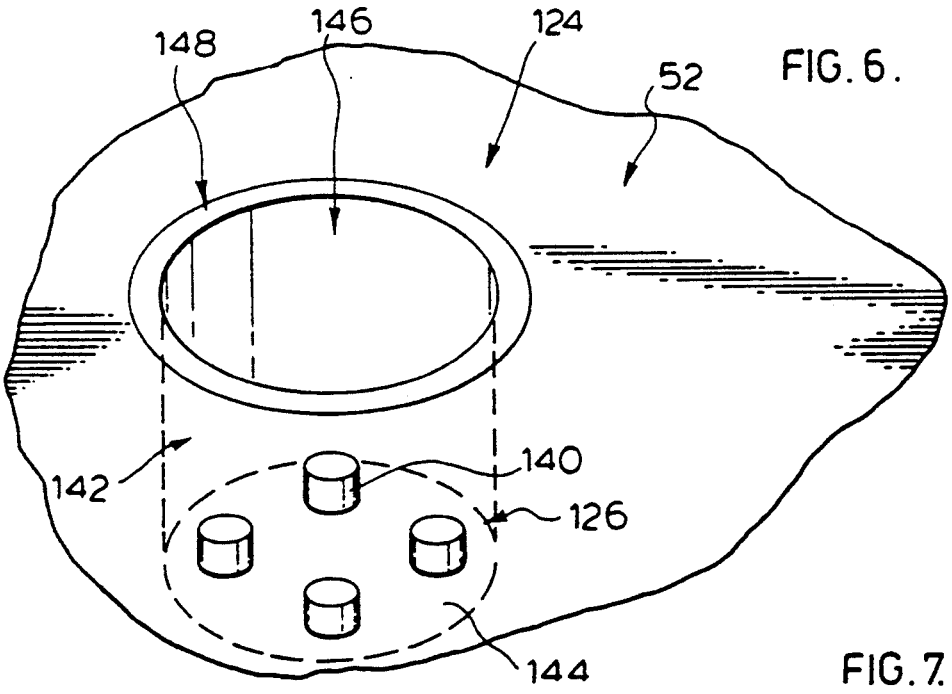
FIG. 6 is an enlarged view of a drilled tie-back well template with a concrete silo formed in the ocean floor.

FIG. 6 is an enlarged view of a tie-back casing. For example, tie-back casing 124 has the four individual wells 126 where each well is capped off with the normal capping device 140. The silo 142 in which the wells 126 are located, is normally made of cement and usually with an ocean sediment foundation 144.

Figure 7:
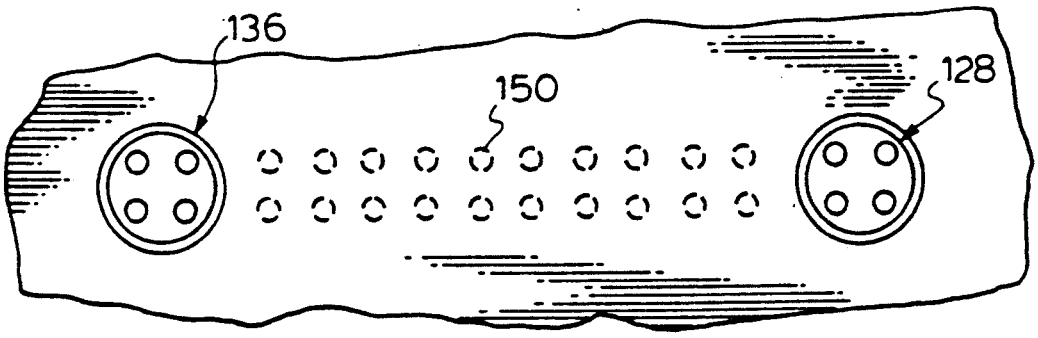
FIG. 7 is a top view of two spaced-apart, tie-back well templates with the locations indicated of the intermediate wells.

The silo 142 normally extends into the seabed to a depth of approximately 10 m. The open top 146 has a peripheral portion 148 which in essence is flush with the ocean floor 52. Hence, four separate jack-up mobile offshore drilling units (MODU's) can be used independently to develop the two sets of tie-back wells. This results in significant costs savings and the potential for use of local drilling equipment in setting up the tie-back wells. For production purposes, assuming the tie-back wells provide the necessary information with respect to full production, then the necessary intermediate wells are drilled between the tie-back wells. This is shown in FIG. 7 where tie-back wells 128 and 136 will eventually have drilled therebetween a plurality of production wells 150 as indicated in dot. Normally, for this spacing of the tie-back wells, approximately 20 additional production wells would be drilled between the tie-back wells. One if the purposes of the caisson is to facilitate the drilling of the production wells 150 during the winter months when drilling with standard MODU'S would have to cease. Such production wells 150 are drilled in a manner to be discussed with respect to FIG. 12 in positioning drilling units on the caisson which drill the wells 150 through the templates 46 as discussed with respect to FIGS. 1 and 4.

Figure 8:
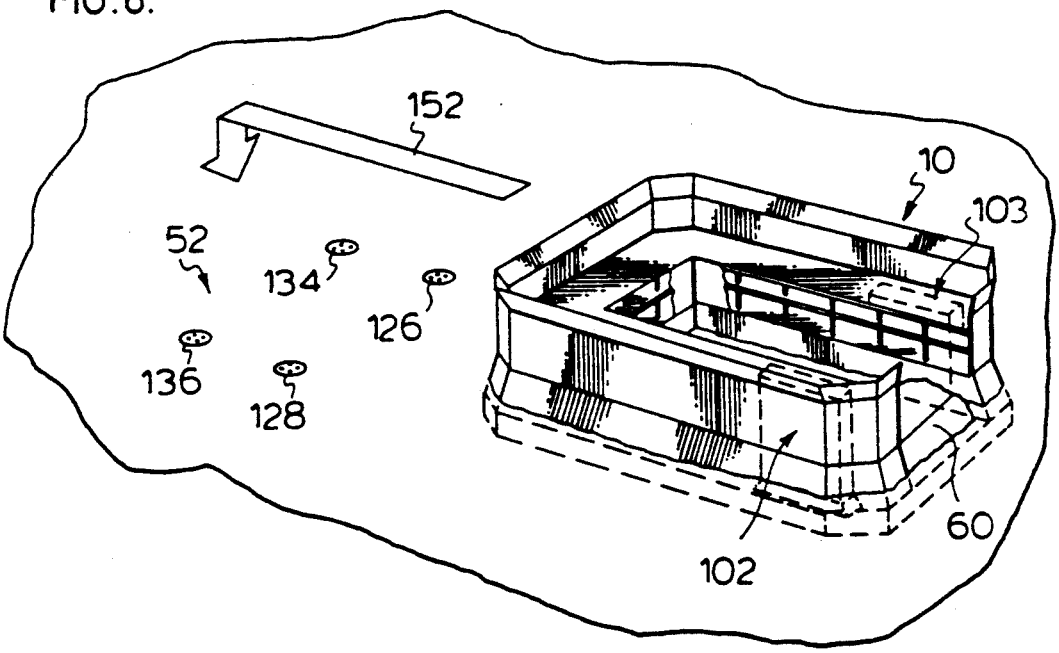
FIG. 8 is a perspective view of the mobile caisson of this invention approaching drilled and completed tie-back wells over which the caisson will rest.
Figure 9:
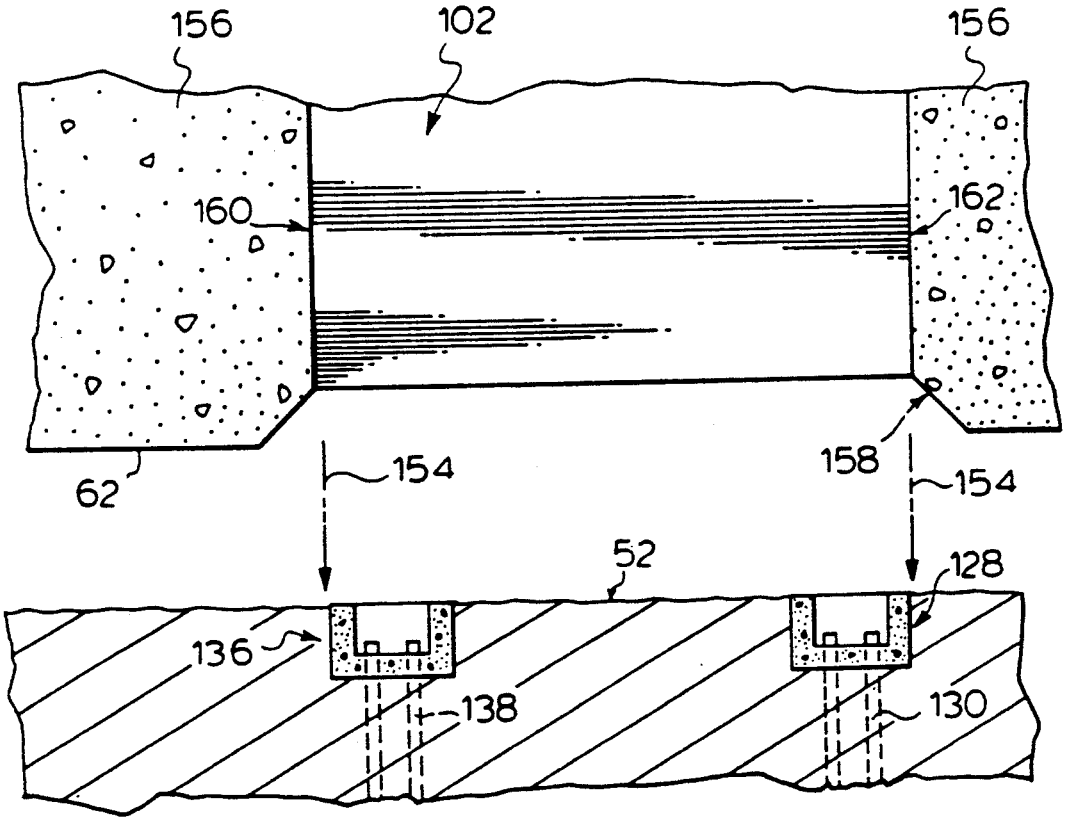
FIG. 9 is a section through a moon pool of the caisson having sloped edges to ensure that the caisson setdown loads will be spread out and away from the general area of the concrete silo thus ensuring the minimum of interference with the silo.

As shown in FIG. 8, the caisson 10 approaches the tie-back wells 126, 134 and 128, 136 in a direction of arrow 152. It is understood that in locating the caisson 10 over these tie-backs wells 2 or more tugs 12, as shown in FIG. 1, may be used, along with a series of tensioning cables which may be positioned outbound of the tug-towing direction. It is also understood that in view of the size and mass of the caisson and the ability of the ice-breaking tug systems that the caisson could be positioned over the tie-back wells after the ocean begins to freeze up. The caisson could be readily positioned in ice thickness ranging from 5 to 10 cm. It is understood that with this thickness of ice any winds do not cause wave action so that there is little chance of an oncoming storm causing sufficient waves to rock the caisson during the locating action. Otherwise, the caisson is located during the summer months with no ice protection, then it is best to locate the caisson over the tie-back wells during forecasted calm periods. It is appreciated that in normal conditions, the caisson can be located over the tie-back wells, usually within a period of a 12 hour shift. Although FIG. 8 is in perspective, it is understood that the respective moonpools 102 and 103 have sufficient crosssectional length to span the respective sets of tie-back wells 126, 134 and 128, 136. As noted with respect to FIG. 5, these tie-back wells are spaced apart approximately 40 m, hence, the cross-sectional length dimension of the respective tie-back well is an excess of 40 m and is normally in the range of 50 to 55 m. Once the caisson 10 is positioned over the tie-back wells, where such positioning can be determined by use of visual means, sonar devices or other underwater inspection systems, ballasting of the caisson 10 commences to lower the caisson onto the ocean floor 52 and to settle the respective wellbays 102 and 103 over the tie-back wells. This action is demonstrated in FIG. 9 where a section through moonpool 102 is shown as the caisson is lowered in the direction of arrows 154. The respective silos 128 and 136 are essentially flush with the ocean floor 52. The moonpool 102, as defined by the caisson perimeter structural portion 156 through which the moonpool extends may be of reinforced concrete or steel structure. The moonpool has the outwardly flared bottom portion 158 which opens outwardly to the underside 62 of the caisson 10. The spacing between the sidewalls 160 and 162 of the moonpool 102 is in excess of the spacing between the respective tie-back wells 128 and 136 by approximately 10 to 15 m. Although it is understood that depending upon conditions and ocean floor topography, a narrower tolerance between the moonpool cross-sectional length and the tie-back wells could be in the range of 2 to 5 m. The outwardly flared portions 158 of the respective moonpool 102 also provide for additional tolerance in positioning the moonpool over the tie-back wells and furthermore, allows miscellaneous sediment to build-up in that area while the caisson is settling onto the ocean floor 52. Once the bottom of the caisson 10 has settled on the ocean floor, visual inspection may be carried out to ensure that the tie-back wells 128, 136 are centred in both length and cross-wise directions of the corresponding moonpool 102. Once the visual checks are complete ballasting of the caisson is finalized to settle the caisson firmly on the ocean floor so that any longitudinal, lateral or rotational drift of the caisson is resisted by its weighted engagement with the ocean floor.

It should also be noted that the outwardly flared portions 158 of the respective moonpool 102 is intended to place the contact point of the caisson base 62 at a considerable distance from the silos in the range of 5 to 7 m or thereabouts, hence, the caisson set-down weight is spread and distributed away from the silos to minimize any external pressure exerted on the silos while the caisson remains in position on the ocean floor.

Figure 11:
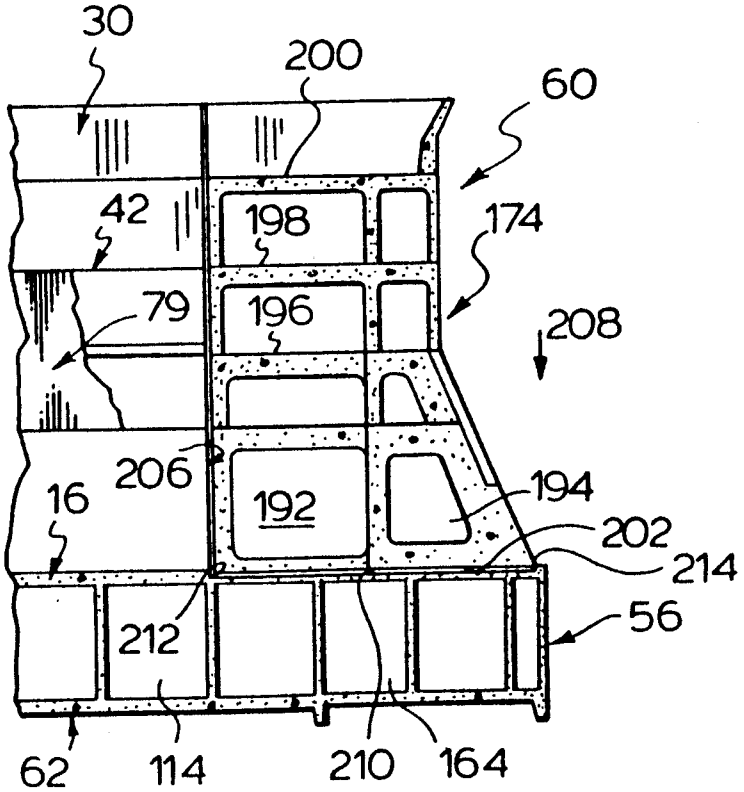
FIG. 11 is a partial section of the caisson rear portion with the door ballasted in closed position on the caisson.
Figure 10:
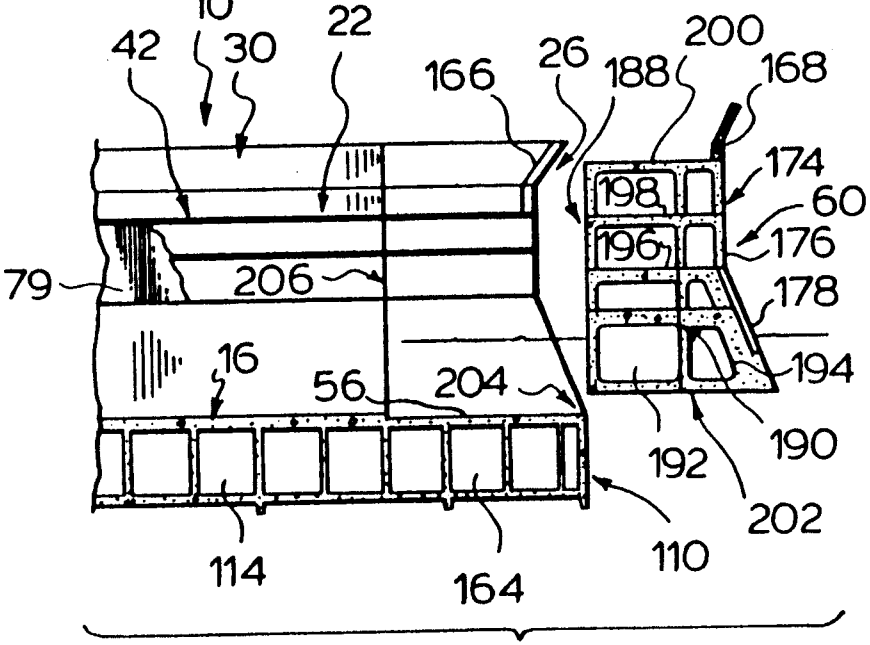
FIG. 10 is a partial section of the rear portion of the caisson with the door in floating position spaced from the caisson.

Prior to discussing the use of the caisson once located over the tie-back wells, the manner in which the door 60 is moved into and out of position to provide access to the cavity 16 is discussed with respect to FIG. 10 and 11. Such door movement is necessary to provide for the entrance and exit of various pieces of equipment which require protection from the environment in the winter months. As shown in the rear portion section of FIG. 10, the caisson ballast tanks in the base 16 are shown at 114. Similarly, in the perimeter portion 110, are the additional ballast tanks 164. The deflector portion 30 of the caisson extends upwardly and outwardly from the sidewall 22 above the upper deck 42. The upper deck 42 extends to the rear face 26 of the caisson, as shown in FIG. 1, with the deflector plate portion 166 over top of the corner portion 36. The door 60 has deflector portion 168 which aligns with the rear deflector portion 170, as shown in FIG. 4. On the other side of the caisson the deflector portion 168 of the door 60 is aligned with deflector plate 172 of the rear wall 28. Also, the rear face 174 of the door is aligned with the rear surfaces 26 and 28 of the caisson. In terms of the vertical portion 176 and the slope 178, they are aligned respectively with the vertical portions 180, 182 of wall 126 and 184 and 186 of wall 28, as shown in FIG. 4. The door forms part of the perimeter of the caisson and hence, has the exterior wall 174 spaced from the interior wall 188. The perimeter portion is reinforced by suitable reinforcement generally designated 190 which may be reinforced steel or reinforced concrete about the ballast tanks 192 and 194 and as well to support the decks 196, 198 and 200 within the perimeter section of the door 60. The door 60 is supplied with its own independent system for either ballasting or deballasting the ballast tanks 192, 194. This determines the extent to which the door 60 floats in the water. As shown in FIG. 10, the door 60 is ballasted to the extent that it floats with its base portion 202 above the rear edge 204 of the caisson base 56. The door may be self-propelled or by use of tugs, the door is bumped towards the opening in the rear of the caisson until the door abuts a ledge portion 206 within the caisson which acts as a stop to determine the extent to which the door enters the caisson and also to ensure alignment of the outer wall 174 of the caisson with the rear wall portions 26 ad 28 of the caisson. As shown in FIG. 11, once the door abuts the ledge 206 the ballast tanks 192 and 194 are additionally ballast to lower the door in the direction of arrow 208 so that the base 202 of the door rests on the surface 210 of the caisson base 56. In addition to ledge 206 is abutment 212 on the interior of the caisson and abutment 214 on the exterior of the base of the caisson which serve to locate and hold the door 60 in position. The abutments 212 and 214, along the ledge 206 on each side of the caisson are sufficient to hold the door in position during towing, positioning and settled positions on the ocean floor.

As shown in FIG. 12, a cantilever jack-up MODU 116 may be positioned near the front wall 24 of the caisson 10. The cantilever jack-up MODU has a normal triangular shaped platform 212 with the downwardly extending jack-up legs 214. The drilling tower 216 is mounted on base 218 which in turn skids on spaced apart rails 220. For various reasons, it is desirable to skid the drill rig 216 and its base 218 onto the deck of the caisson 10 so that drilling may continue during the winter months through the respective wellbay and the triangular shaped platform with its legs stored within the caisson cavity 16 for purposes of protection. As shown in FIG. 12, access to the respective deck 42 or 44 is provided by opening of the frontal portions of the caisson. The side deflector plates are divided into separable portions 222 and 224 which may be flipped over to rest against the interior front face 226 and interior side face 228, as shown by the downwardly depending hinged portion 230 and 232. With these deflector plate portions 222 and 224 hinged out of the way, the remaining frontal portions which include the deflector plates 234 and 236 may be hinged in the direction of arrows 238 and 240 where these sections, including the respective inside portions are moved outwardly to expose the respective tracts 90 on the deck 42. Similarly, with deck 44, portions 242 and 244 are already swung out of position, to provide access to the rails 246 on the deck 44. The drill rig 216 with base 218 is then skidded onto the rails 246 and skidded in the direction of arrow 248 so as to be positioned over the moonpool in the vicinity of arrow 102 so that the drill rig 216, with base 218 is in its drilling position, as shown in dot. If it is desired to retain one or two cantilever jack-up MODU'S which have unloaded their drill towers, they may be stored during the winter months within the cavity 16 of the caisson 10. As shown in FIG. 12, cantilever jack-up MODU 118 has already unloaded its drill tower 252 with support base 254 onto the rails 90. The cantilever jack-up MODU 118, as shown in dot is stored within the cavity 16 by removal of the door 60 and the floating of the MODU into position. Similarly, cantilever jack-up MODU 116 may be floated around and positioned within cavity 16 in the inverse position to cantilever jack-up MODU 118 so that up to 2 MODU'S may be stored within the caisson for purposes of winter storage and hence, protected from the elements. This is further described, as discussed with respect to FIG. 13.

In a situation where two cantilever jack-up MODU'S 116 and 118 are stored within the caisson 10 with their respective drill rigs 216 and 252 positioned over the respective wellbays 102 and 250. The remaining MODU'S 120 and 122 with their drill rigs 256 and 258 may leave the drilling area in the direction of arrow 260 before freeze-up with minimal risk of damage of these respective MODU'S.

Figure 13:
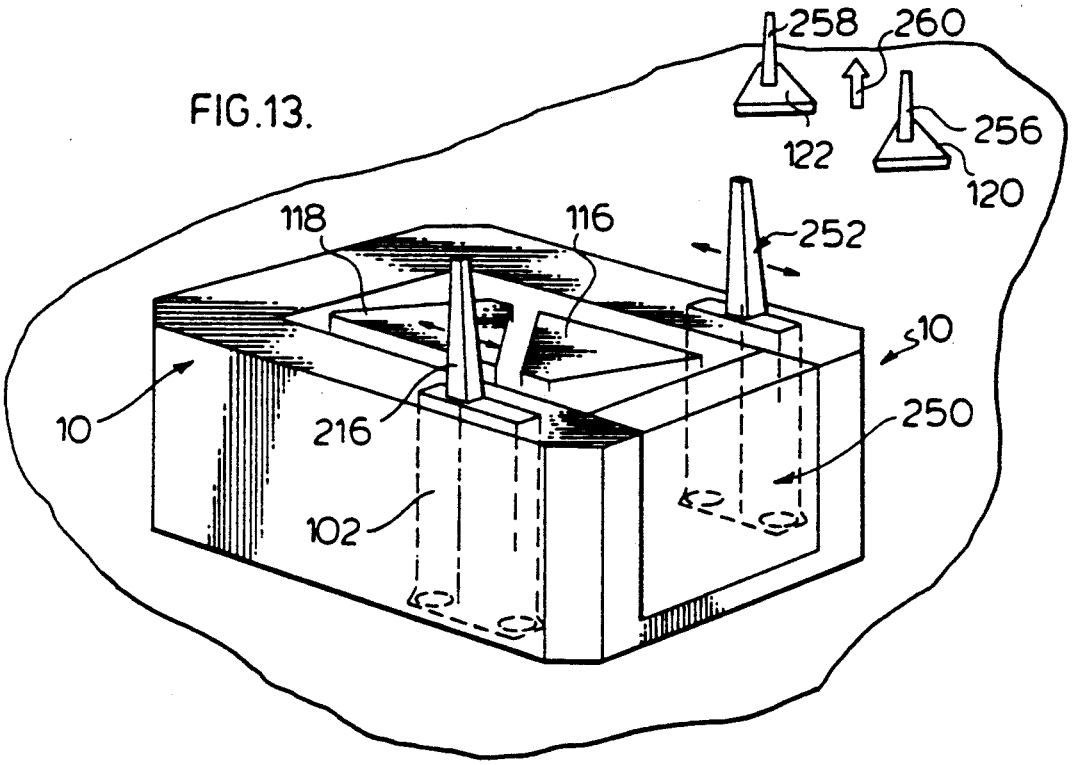
FIG. 13 is a perspective view of the caisson having two drilling units in place over the respective moonpool areas and the remaining two mobile offshore drilling units leaving the site with the onset of winter.

There is a significant economic advantage and reduced capital expenditure program associated with this type of drilling program. As already noted with respect to FIG. 5, four MODU'S can work during the summer months to prepare the necessary tie-back wells. As winter approaches, and as shown in FIG. 13, only two of the MODU'S 116 and 118 need remain with their respective drilling rigs 216 and 252 in position to continue drilling of the remaining wells between the tie-back wells over the winter months. During such drilling the MODU'S 116 and 118 are protected within the caisson. Hence, readily available inexpensive drilling units may be used without the need to reinforce such units for use in ice environments and the other two MODU units may be taken away from the site because they are no longer needed.

Figure 14:
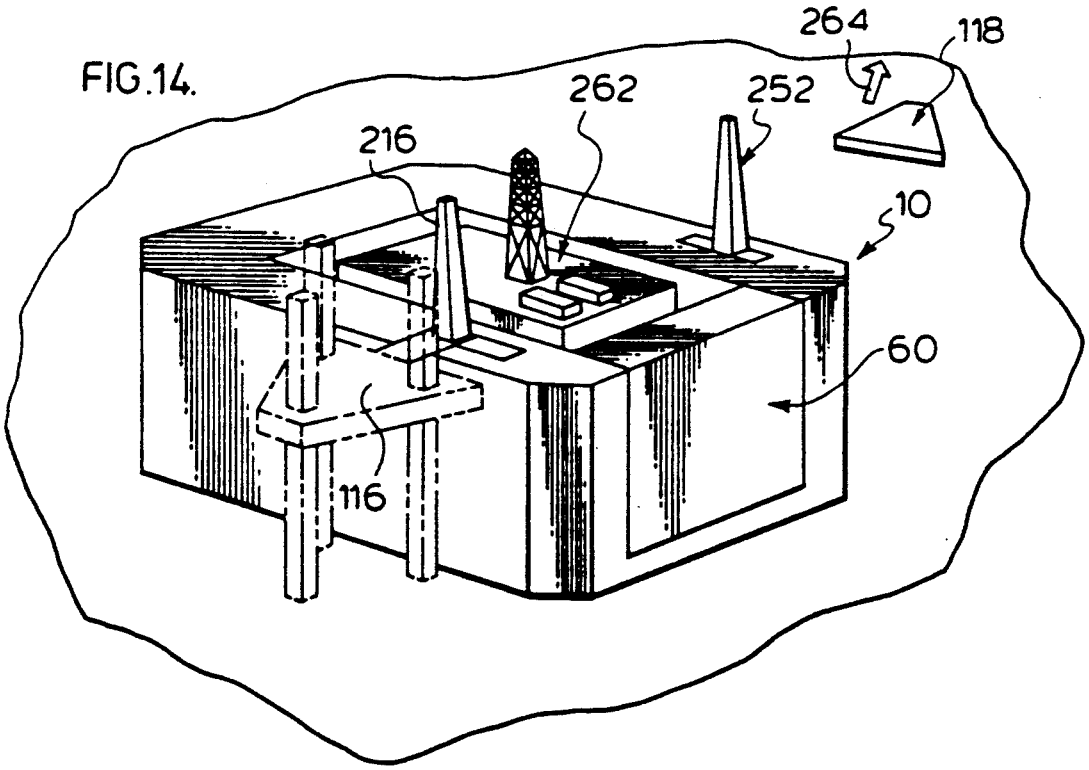
FIG. 14 shows the positioning of a mobile offshore drilling unit drilling at the side of the caisson to provide for additional wells during production.

Assuming that all the necessary drilling has been accomplished during the winter months, as shown in FIG. 14, a production unit generally designated 262 may be positioned within the caisson 10 to commence production from the wells provided beneath the moonpools 102 and 250. The production unit 262 may be any of those commercially available such as semi-submersible units which are normally used in ice-free offshore locations. The production unit may be towed to the caisson 10 when the ocean has opened up of ice, the semi-submersible production unit may be positioned within the caisson 10 where it is protected during future winters. Furthermore, the cantilever jack-up MODU 118 may leave the area in the following summer in the direction of arrow 264 while leaving its drilling rig 252 on the caisson 10 to perform additional drilling as needed. Cantilever jack-up MODU 116 can remain on side to complete drilling with its drilling rig 216 through the respective moonpool for the reasons to be discussed with respect to FIGS. 16 and 17. When all drilling has been completed by cantilever jack-up MODU 116 and the winter months are setting in it is then necessary for modul 116 to leave the area and perhaps the drilling rig 216 on the platform to ensure that the cantilever jack-up MODU 116 is not damaged by developing ice.

It is appreciated that with respect to the discussion of FIGS. 13 and 14, for sake of clarity in the illustrations, the deflector plates and details of the caisson have not been provided in the schematics to demonstrate the important functions of the caisson in reducing capital expenditure by virtue of efficient drilling and production.

Figure 15:
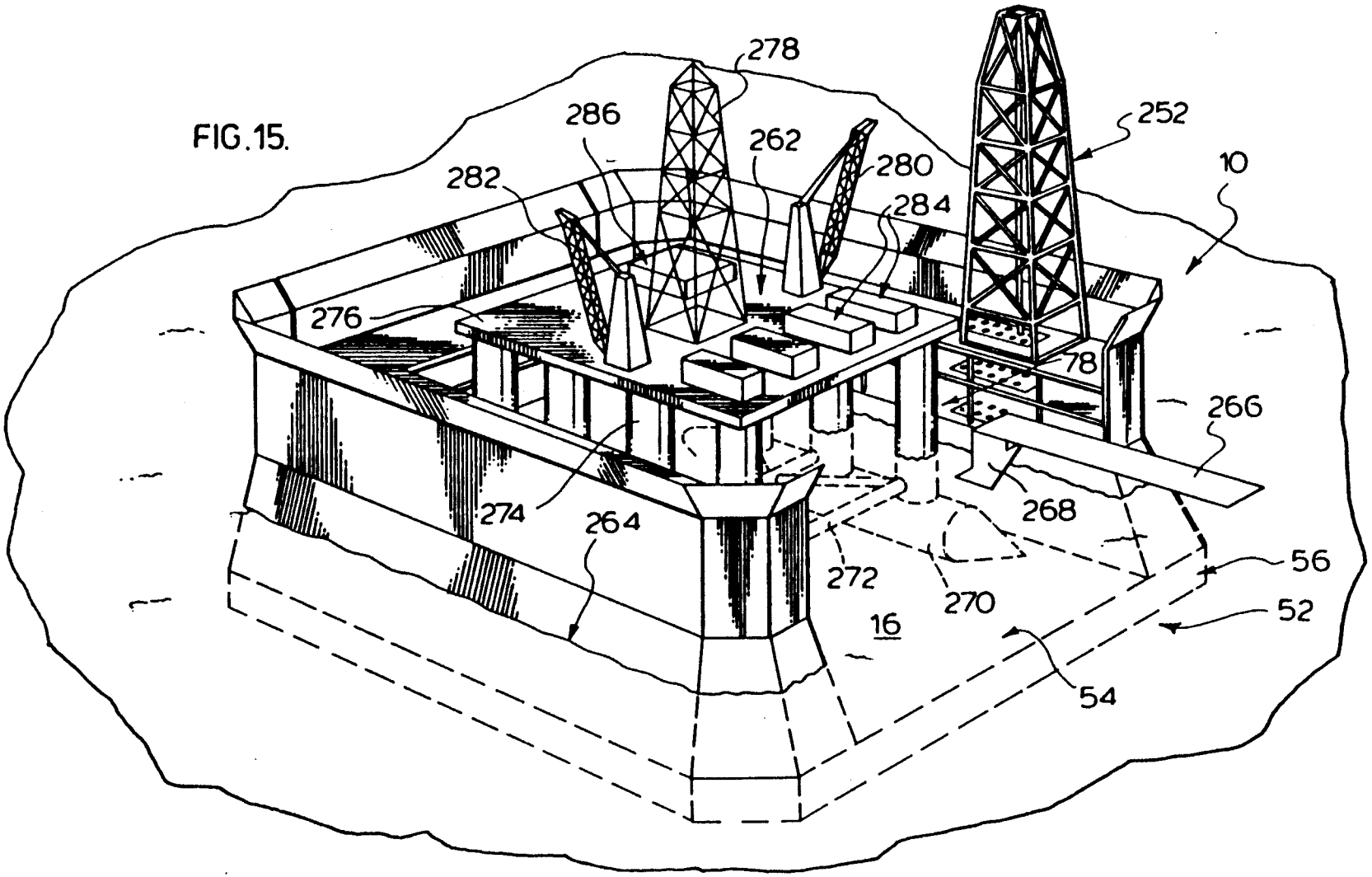
FIG. 15 demonstrates the entrance to the caisson with the rear door removed of an ice crush sensitive oil production semi-submersible system.
Figure 16:
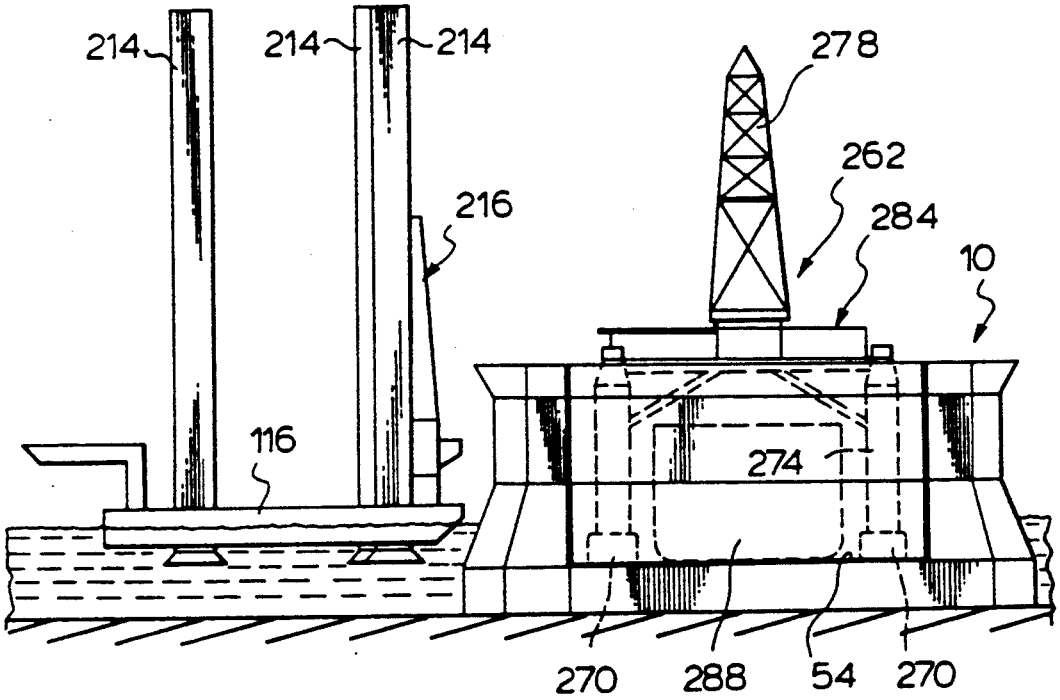
FIG. 16 is a side elevation showing an oil production system in place within the caisson and protected from the environment with a jack-up unit approaching the caisson.

With reference to FIG. 15, the provision of the production unit 262 within the caisson 10 is shown. The caisson 10 is in the submerged position with the base 56 on the ocean floor 52. The rear door 60 is removed. It is noted that with the caisson submerged the water level, as indicated by line 264, is considerably beneath the lower deck 78 so that water within cavity 16 does not find its way onto the deck surfaces. The semi-submersible production unit 262 floats in a direction of arrow 266 and is ballasted to sink in the direction of arrow 268 to rest on the floor 54 of the caisson base 56. The production unit 262 is the standard semi-submersible type having pontoons 270 with supporting grid work 272 and pylons 274 which support the production deck 276. The standard type of production unit 262 has the standard type of production crane 278 which may, if need be, removed from the production deck. The production deck also supports production cranes 280 and 282 with the usual production facilities generally indicated at 284 and 286. By use of appropriate ducting and hosing the oil from the production wells of the respective wellbays is transferred to the production unit 262 for processing. The process crude oil is then stored within the tanks of the caisson base such as tanks 114. It is also understood that during production, drill unit 252 may continue drilling additional wells or redrilling old wells to enhance production as required during the life of the oil wells. It is also understood that during production in the case of a blowout, drill unit 252 can be used to drill and provide pressure relief for the blowout well. This is also particularly advantageous during the drilling operation for purposes of alleviating blowouts which will be discussed in more detail with respect to FIG. 18. As shown in FIG. 16, the production unit 262 with its pontoons 270 rests on the floor 54 of the caisson 10. The production unit has its lower ribbing 272, as shown in FIG. 15 removed and between the pontoons 270 is a storage bulkhead system 288. This can provide for additional crude oil storage during the extended winter months of production. As already noted, with the additional storage 288, the total capacity of the caisson may exceed 1,000,000 barrels.

Figure 17:
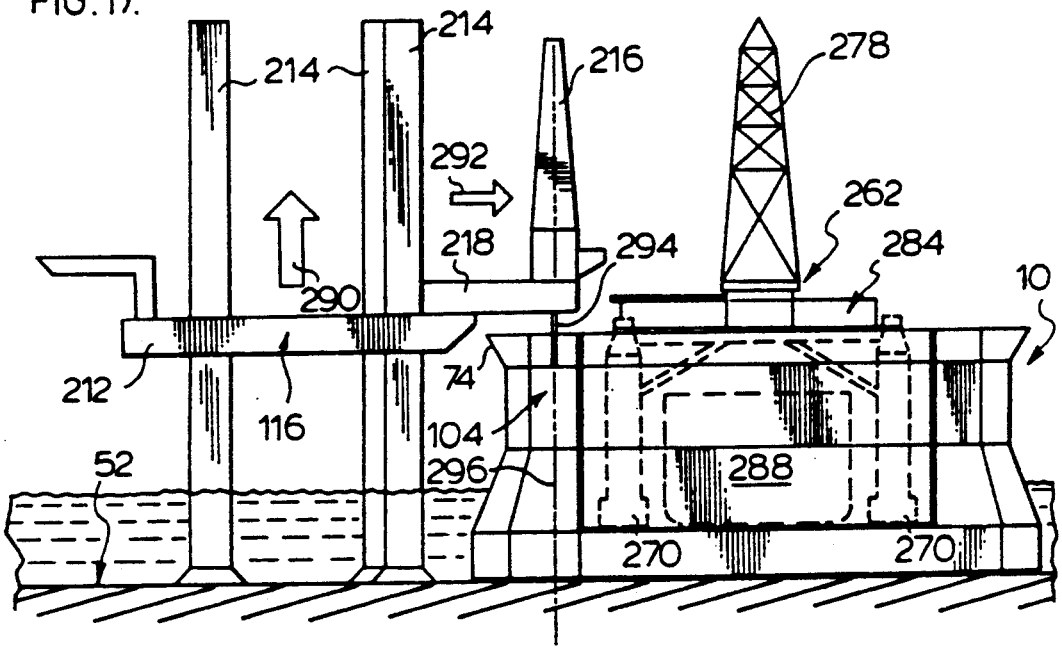
FIG. 17 shows the jack-up unit of FIG. 14 in position beside the caisson to carry out additional drilling while production continues in the caisson.

Also, as represented in FIG. 16, is the use of a cantilever jack-up MODU to carry out additional drilling and possible oil well workover operations while production continues with the production facility 262. This aspect of the caisson provides the significant advantage in that a drilling rig need not be retained on the caisson during production periods. Instead, during the summer months when the ocean is open the drill rig 116 may be floated up to the caisson, as shown in FIG. 16, then the drill rig, as shown in FIG. 17 may have its legs 214 extended to rest on the ocean floor 52 and elevate the platform 212 above the level of the deflector 74. The platform 212 is jacked-up legs 214 in the routine manner in the direction of arrow 290. With the platform 212 above the lip 74, the drill tower 216 with its based 218 is skidded on the rails of the tower in the direction of arrow 292 to position the tower 216 with drill string 294 over the wellbay 104 so that drilling can commence, as indicated by dotted line 296 through the respective well in the ocean floor 52 or to establish a new well within the confines of the wellbay between the respective tie-back wells.

Figure 18:
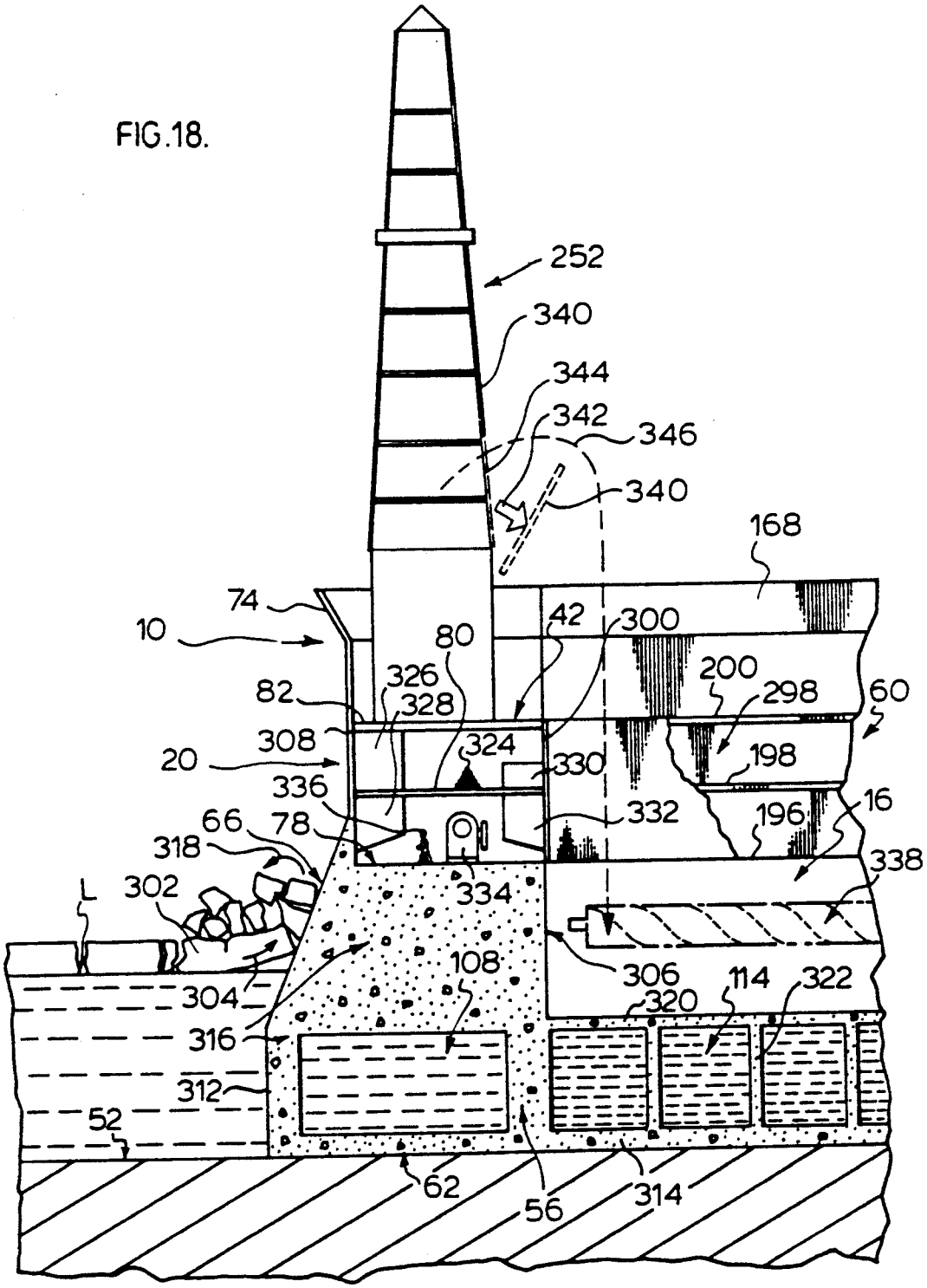
FIG. 18 is a side elevation of the caisson with a drilling tower in place on the platform, the drilling tower has its side panels directed to the inside of the caisson weakened relative to the other panels such that on blow-out the inside panels release directing oil to the interior of the caisson for containment and separation from the water.

A section through the caisson is provided in FIG. 18. The section is taken through the caisson in front of tower 252 looking towards the rear of the caisson 10 with the door 60 in place. The caisson has on its interior, the already noted deck surfaces 78, 80 and 82 of the working deck 42. The rear door 60 has the upper deck 200 and lower decks 196 and 198. The decks are enclosed by suitable cladding as generally designated 298 and a section of which is shown at 300. As shown in FIG. 18, the water level L is well below the deck 78 and 196 should there be for whatever reason a build-up of water in the cavity area 16.

The perimeter of the caisson 10 which resists the inward flow of ice, as indicated by arrow 304, has the exterior surface 20 and the interior surface 306. In the decking regions the exterior surface 20 comprises reinforced steel plate 308 with the normal deflector portion 74. This plate 308 extends around the entire external perimeter of the caisson. The lower part of the caisson is significantly reinforced to withstand various external and internal pressures applied to the caisson perimeter. According to this embodiment, the caisson 10 has a reinforced perimeter defined between in the exterior wall 20 and interior wall 306 which in accordance with this embodiment, is of reinforced concrete 310. The reinforced concrete may extend from the deck 78 down to the base 62 of the caisson 10. The exterior surface 20 of the caisson has beneath the plating 308, the inwardly sloping surface 66 and the lower vertical surface 312 of the base portion 56. The base portion 56 has a reinforced bottom 314 which rests on the ocean floor 52. Extending upwardly from the bottom 314 is the reinforced perimeter portion 316 which is of reinforced concrete and which is of sufficient structural strength to resist the pressure exerted by any iceflows bumping up against the caisson or perhaps possibility of a ship bumping up against the caisson. The upper surface 66 if of substantially thicker reinforced concrete 310 to resist the pressures exerted by the ice 302 moving against the caisson in the direction of arrow 304. The surface 66 is sloped, as shown, to turn the ice upwardly such that it falls back on itself in the direction of arrow 318. This causes the ice to crumble and reduces the lateral forces exerted on the caisson. In any event, the thickness of this perimeter portion of the caisson is always sufficient to withstand any maximum design ice loading. Around the perimeter portion of the caisson are the ballast tanks 108, a section through which is shown. The interior of the caisson are the additional ballast tanks 114. During normal production the outer ballast tanks 108 are filled with water and the inner tanks 114 of the caisson are filled with crude oil. It is appreciated that when oil is not present in the ballast tanks 114, water may be substituted for the crude oil. As crude oil is stored in these tanks, the water is pumped out and treated before discharge. As shown in FIG. 18, the ballast tanks 114 may be formed within reinforced concrete 320 where the tanks are partitioned by reinforced concrete 322. It should be understood that dependent on the local construction infrastructure the caisson could be built wholly of concrete or steel or a steel/concrete combination.

The decks within the perimeter portion of the caisson carry all of the mechanical electrical support systems for drilling and/or production, where such provisions complement the machinery and electrical already provided on the drill rigs and production rigs. Drill rod 324 may be stored on deck 80. As well, mud and other drilling compounds may be stored in tanks 326 and 328. Other powders and the like for purposes of drilling and production may be stored in tanks 330 and 332. It is understood that these various tanks may extend around the majority of the production and/or drilling platforms other than perhaps the area of the moonpools. Pumps and the like may also be positioned on deck 78. For example, pump 334 is shown which may be used in drilling production or the movement of liquids into and out of the ballast tanks, whether it be water or oil. Also, for purposes of scale, the relative height of a workman 336 is shown.

An advantage in the design of the caisson 10 is the ability to control blowouts which may happen during drilling and/or production. The rear door 60 is provided, as schematically shown with an oil skimming device 338. It is possible during a blowout to design the tower 252 in a manner such that the panel 340 which encloses the tower are weakest on the side adjacent the cavity 16. In the event of a blowout, the weaker panels 340 can be blown from the tower in the direction of arrow 342. This allows the crude oil gushing from the oil well to be deflected through the opening 344 in the tower and in the direction of arrow 346, the crude oil drops into the cavity 16. Normally the crude oil, as it blows from the drill hole, contains considerable water, hence, the separator 338 serves to separate the oil from the water where the separated oil may be stored in the tanks 114 and the water with minimal crude oil content may be further treated and/or discharged to the ocean. Hence, in the event of a blowout, an environmental disaster is avoided by the ability to collect the oil within the cavity and at the same time skim off the oil for storage. Another advantage of the caisson, as discussed with respect to the earlier Figures, is the ability to have two independent drill towers on the caisson. In the event of a blowout the other drill tower may be used to drill a relief hole into the well which is out of control so that the blowout hole can be capped off. Furthermore, the accommodation with is located on the forward portion of the caisson on deck 40 is usually spaced from the drill towers by approximately 100 yards so that the crew can remain on the caisson during the stages of diverting or sealing off the oil well.

Figure 19:
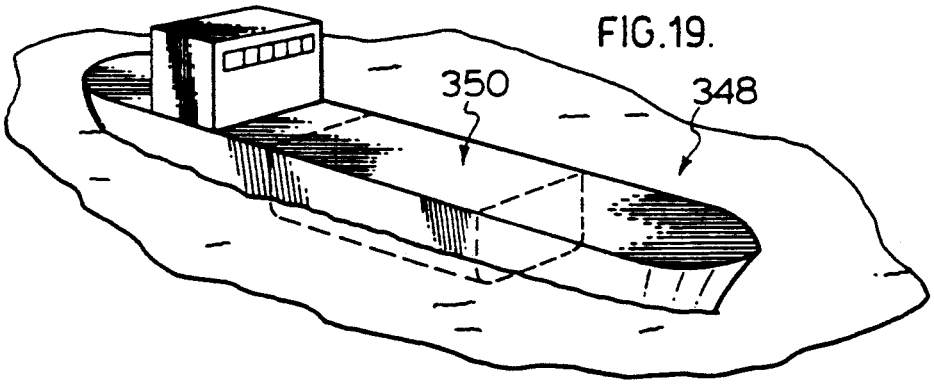
FIG. 19 shows an oil tanker to receive oil from the mobile caisson.
Figure 20:
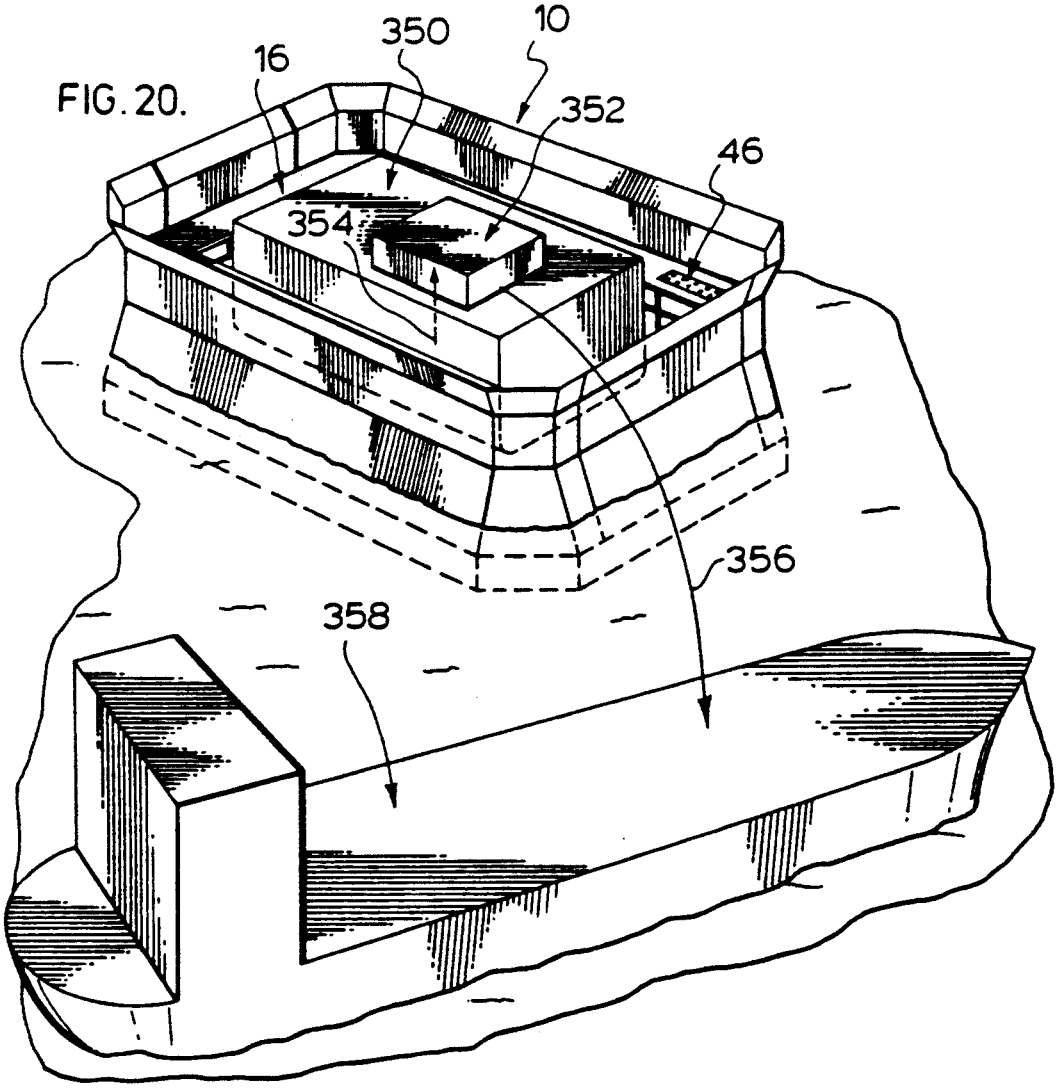
FIG. 20 is a perspective view demonstrating the offloading of oil from the mobile caisson to the oil tanker.

Another use for the caisson is demonstrated with respect to FIGS. 19 and 20. The caisson can be used as a crude oil holding facility in the arctic for use in filling tankers with oil derived from onshore drilling and production facilities. As shown in FIG. 19, an ocean going tanker 348 has the usual tanker storage system 350. Although such tankers are not built for arctic use and many of them have been discarded due to obsolescence or uneconomic power plants it is possible to cut the tanker storage system 350 from the ocean going ship and without any additional reinforcement, place it within the cavity 16 of the caisson 10 as shown in FIG. 20. On top of the removed storage tank system 350, a suitable crude oil pumping device 352 may be provided. The oil is then pumped from the tank storage system 350 in the direction of arrow 354 and delivered through hose 356 to an ocean going tanker 358. Hence, the caisson provides a relatively inexpensive stable system for use in the Arctic where the storage is provided by an inexpensive unreinforced ice crush sensitive oil storage system which is readily available in the marketplace.

In view of the detailed discussion of the preferred embodiments, it becomes readily apparent that the caisson of this invention provides many advantages and features not realized with existing systems. As previously noted, there is a very limited open water season which exists in most Arctic areas. It was therefore thought impractical to complete a large number of predrilled wells prior to the installation of the drill platforms. It was also thought not feasible to have several rigs drilling over several templates, for example, the installation of tie-back wells. In the past, the large dedicated drilling rigs were used which added significantly to the overall cost of achieving production. However, with the use of the caisson of this invention, tie-back wells can be pre-drilled in the summer months before the location of the caisson system and once the caisson is in place, drilling throughout the year can now be accomplished to significantly reduce the overall cost in achieving production. The templates, as provided on the caisson for drilling the wells between the tie-back wells, is designed to be long and thin thus minimizing the distance between the wells and the edge of the caisson. This allows conventional jack-up mobile offshore drilling units to come up along side the caisson and do additional drilling and or workover of existing wells. Sufficient storage can be provided on the caisson within the decking systems to allow continuous winter drilling with both sets of drill systems without the need for re-supply. Another advantage in locating the ice crush sensitive drill rigs within the caisson during the winter months while drilling continues is that the drill units may be jacked-up so that their weight is transferred to the floor of the caisson which further adds to the overall dead weight of the caisson to provide greater resistance to sliding of the caisson during the winter months when ice loads are at their highest. The caisson also permits the use of existing semi-submersible drill units, production facilities and the like to significantly reduce capital expenditures associated with arctic drilling and production. It is also understood that the drilling oil production storage and accommodation facilities are not dedicated to the caisson and that design variations may be achieved without limiting the caisson to a particular application, hence, the caisson is useful in small, mid-size to large oil field developments because all of the drilling production storage and accommodation may be geared to that particular development and if the caisson is then used in a larger facility or a smaller facility the drilling production, accommodation, storage facilities may be correspondingly altered. This caisson therefore provides a unique ability to be built up in stages to service a variety of different duties and is not governed by the process sizing as are normal offshore platforms. The ability to stage the capital expenditures to reflect the exploration/development results makes it ideally suited for use in arctic developments.

In summary, the caisson has the following advantages and features:

i) the potential to make use of standard North Sea MODU's or Floating Production Units (FPU's) as an integral part of arctic developments. The ability to transport these MODU's/FPU's safely into arctic waters inside the safe environment provided by such a caisson. The ability can extend to the complete re-use of existing North Sea production topsides which after completion of their useful life on their original field, could be refurbished and taken directly into such a caisson. The potential savings in terms of cost and time of such an option would be immense and would represent a considerable breakthrough in achieving cost effective arctic developments.

ii) the flexibility offered by its modular design allows the caisson to respond to the development's needs ra35 ther than be dictated by the eventual process design. This allows for efficient phasing of the project capital expenditures and thus ensures a financially viable project. This caisson is therefore suited to small, medium and large field design with flexibility to be an economic solution for any of these cases.

iii) use of skidded jack-up drill packages can now be achieved, iv) conversion of a portion of the caisson set down weight to useful facility space, v) packaging of drilling facilities in the most efficient surface area manner, vi) separated wellbays are provided to ensure built-in relief well capability on the caisson, through the ability of one rig to drill the other's relief well. A further benefit of this arrangement is the ability to have four tie-back moonpool areas which allows drilling operations by four jack-ups simultaneously thus achieving a, hereto unavailable, rapid cost effective means for pre-drilling arctic developments wells using conventional equipment, vii) through the ability to make meaningful use of conventional MODU's in the drilling and production mode coupled by the simplicity and ease of construction of the caisson, it is possible to achieve extremely high levels of local content and, as such, this caisson offers significant socio-economic benefits to the arctic regions, and viii) sufficient oil storage to support year round offshore arctic production.

Although preferred embodiments of the invention are described herein in detail, it will be understood by those skilled in the art that variations may be made thereto without departing from the spirit of the invention or the scope of the appended claims.

I claim:

1. A submersible mobile caisson having ice crush resistance for adapting mobile offshore drilling units and mobile offshore oil well production rigs which are ice crush sensitive, for use in ice bearing offshore ocean waters, said caisson comprising:

i) a floatable generally four-sided caisson with a fixed upstanding front outer wall and fixed upstanding opposing side outer walls and an upstanding rear outer wall having a removable entrance door, ii) said caisson being of a height to permit offshore drilling and/or production when said caisson is submersed to rest on an ocean floor, iii) said outer walls being reinforced to withstand crushing forces exerted by ice bearing offshore oceans and said outer wall height being sufficient to turn back a maximum design wave, said outer walls having an inwardly sloping wall portion about the caisson perimeter above and below submersed water level to wedge upwardly advancing ice, iv) a cavity being provided within said upstanding front and rear outer walls and said opposing side outer walls, access to said cavity being provided by removing said entrance door, v) said cavity being defined by a base, a front inner wall, opposing side inner walls and a rear inner wall on said entrance door, said inner walls being spaced from corresponding said outer walls of said front and opposing sides with an upper support deck spanning said spaced apart outer and inner walls, said front, said rear including said door and said side inner and outer walls defining a caisson perimeter structure, the interior space of said cavity being protected from ice crushing forces by said caisson perimeter structure, iv) said perimeter structure and said base having a plurality of ballast compartments to float said caisson and when said compartments are filled with a ballast liquid, said caisson sinks towards and rests on the ocean floor where said caisson perimeter structure is of a height to provide above water level a sea break to safeguard operating facilities and personnel, vii) said base of said cavity being positioned relative to said deck to provide sufficient draft when said caisson is floating and said door is open to permit entrance and exit of mobile offshore drilling units and/or production units, viii) said deck along each of said opposing side walls having at least one drilling/production service hatch, ix) each portion of said perimeter structure which extends along said opposing side walls having extending vertically therethrough, a drilling/production moon pool system which extends from and is in communication with said corresponding service hatch, x) said caisson perimeter structure comprises an ocean floor perimeter foot portion of solid reinforced structural material, said cavity base being of reinforced structural material tied into said perimeter foot portion, xi) said inner and outer walls to at least above submersed water level when said perimeter foot is resting on ocean floor are of reinforced structural material, said plurality of said ballast compartments being provided between said inner and outer walls with a majority of each ballast compartment being below submersed water level when said perimeter foot is resting on ocean floor.

2. A caisson of claim 1 wherein:

said entrance door extends between said opposing side inner walls to define said rear inner wall, means for mounting said entrance door to said perimeter structure, said door completing said outer rear wall when said door is in place on said mounting means.

3. A caisson of claim 2 wherein:

said entrance door has a bottom portion of reinforced structural material, between the inner rear wall and the outer rear wall said reinforced material extending to at least above submersed water level when said perimeter foot is resting on ocean floor, said entrance door having ballast compartments to float said door, said mounting means releasing said door as it floats and said mounting means re-engaging said door to mount it in place on said perimeter structure when said door is filled with ballast liquid.

4. A caisson of claim 1 wherein:

said moonpool system comprises spaced apart multi-well templates where spacing between said templates permits drilling and/or connection to tie back wells.

5. A caisson of claim 4 wherein:

said deck for each of said opposing side walls carries support facilities for a drill rig to permit simultaneous and/or independent drilling through said moonpool systems in each opposing caisson side.

6. A caisson of claim 5 wherein said outer walls comprise an upper perimeter section having an outwardly sloping wall portion to deflect outwardly wave action of offshore oceans, said upper perimeter section being located above said deck, said front outer wall having means for providing access to said upper perimeter section, said access means being aligned with said deck along a corresponding side wall, said access means having a wall portion which moved aside to permit skidding of a drill rig from a mobile offshore drilling unit onto said deck.

7. A caisson of claim 6 wherein each of said decks along a corresponding said side wall has a skid beam structure, along which said drill rig is skidded to work at said corresponding moonpool system.

8. A caisson of claim 1 wherein said ballast compartments in said cavity base are provided for crude oil storage.

9. A caisson of claim 8 wherein said ballast compartments for oil storage have a capacity in the range of 500,000 barrels to 750,000 barrels.

10. A caisson of claim 7 wherein said drill rig is enclosed with panels, said panels along said drill rig adjacent said cavity being adapted to blow off when a well being drilled blows out to direct thereby upcoming gushing oil into said cavity.

11. A caisson of claim 10 wherein said door comprises means for separating oil from water which collects in said cavity.

12. A caisson of claim 11 wherein means for transferring separated oil to said ballast compartments is provided said oil transfer means transferring oil to said ballast tanks in said caisson base.

13. A caisson of claim 1 wherein said caisson perimeter structure is formed of solid reinforced concrete at least in said outer wall to above submersed water level and said foot portion is formed of solid reinforced concrete.

14. A caisson of claim 1 wherein said caisson perimeter structure is formed of reinforced steel at least in said outer wall to above submersed water level and said foot portion is formed of reinforced steel.

15. A caisson of claim 1 wherein said moonpool system comprises a silo extending through said perimeter structure, said silo having at its base, opposing end walls which slope downwardly and outwardly from said silo, said sloping walls providing a distribution of loads outwardly of tie back walls when said caisson is lowered onto ocean floor.

* * * * *